US005857227A

United States Patent [19]

Trusty et al.

[11] Patent Number: 5,857,227

[45] Date of Patent: Jan. 12, 1999

[54] VERTICALLY ADJUSTABLE SHOWER HEAD

[76] Inventors: Linda Trusty; Jack D. Trusty; Ian J. Bromidge, all of 5138 Mill Stream Rd., Orlando, Fla. 32818

[21] Appl. No.: 639,335

[22] Filed: Apr. 26, 1996

[51] Int. Cl.[6] ..... A47K 3/22

[52] U.S. Cl. ..... 4/605; 004/615; 239/282

[58] Field of Search ..... 4/541.6, 567, 568, 4/570, 596, 605, 606, 615; 239/282, 588

[56] References Cited

U.S. PATENT DOCUMENTS 2,685,093 8/1954 Lundquist ..... 4/615

3,737,107 6/1973 Wright ..... 4/615 X 3,806,963 4/1974 Flynn ..... 4/615

*Primary Examiner*—Robert M. Fetsuga

[57] ABSTRACT

A vertically adjustable shower head supported by a movable bracket to which rollers are laterally attached that move within guiding track rails behind a shower stall wall. The invention also has a cover plate flush against the shower stall wall, water resistant flaps through which the shower head is positioned and supported, and a gutter system behind the shower stall area water which has moved behind the water resistant flaps.

15 Claims, 3 Drawing Sheets

Figure 5
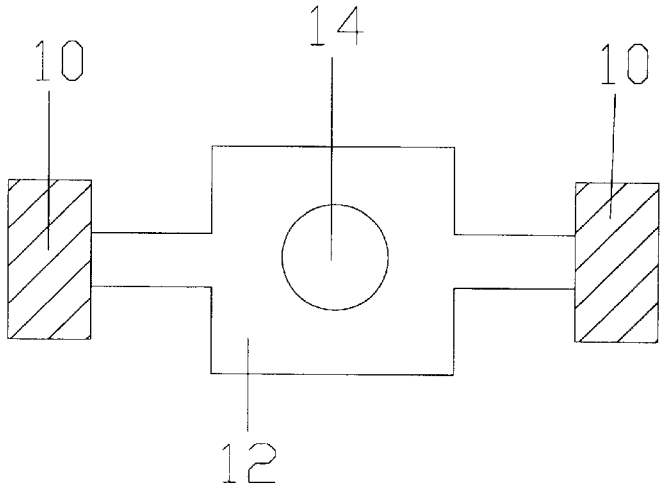
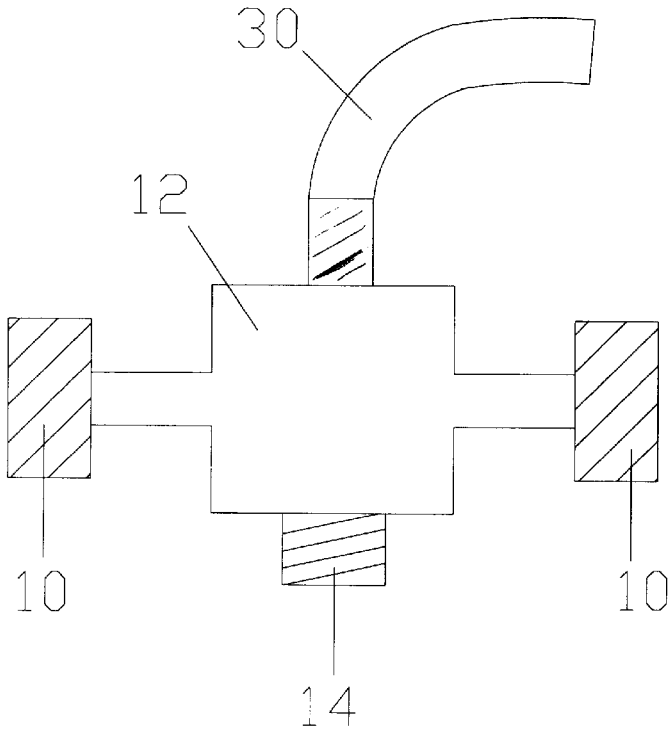
Figure 6

VERTICALLY ADJUSTABLE SHOWER HEAD

BACKGROUND—FIELD OF INVENTION

This invention relates to adjustable shower head assemblies, specifically to a vertically adjustable shower head attached to a movable bracket onto which rollers are laterally attached that move within guiding track rails behind a shower stall wall. The invention also has a cover plate flush against the shower stall wall, a pair of water resistant flaps which support the shower head and provide a water seal around it, and a gutter system behind the shower stall wall to redirect into the enclosed shower stall area any water which moves between the water resistant flaps.

BACKGROUND—DESCRIPTION OF PRIOR ART

Shower heads in private homes, as well as those in most health care facilities and hotels, are usually mounted on shower stall walls in fixed positions to accommodate people of average height. Neither tall people, nor very short people, are comfortable using such a shower head. Tall people have to bend over for water to reach their shoulders, neck, and head, while short people usually get water splashed in their faces. Even when a shower head can swivel, as most do, the angular changes possible do not adequately compensate for the limitations inherent in a shower head mounted for people of average height.

Some shower heads are attached to flexible tubing and mounted in the usual manner to fixtures positioned to accommodate people of average height. When desired for hand-held use, such shower heads are detachable from that fixture. Although convenient to accommodate both tall and short people, the hand-held aspect of it becomes a disadvantage in other respects. The main disadvantage is that the hand which holds the shower head is limited in its usefulness for other tasks associated with bathing, such as opening shampoo bottles, washing hair, and creating soap lather. Performing such tasks may still be possible, but they become more awkward to perform while also holding the shower head. Also, the flexible tubing has a tendency to become tangled and get in the way during use.

Many wall mounted adjustable shower head inventions have attempted to solve the problem of providing a shower head which is equally comfortable for tall people and short people to use. Several prior art inventions closely resemble the appearance of the present invention. However, each has some functional differences and at least one disadvantage which is overcome by the present invention. One such invention is the adjustable shower head disclosed in U.S. Pat. No. 4,360,159 to Haynes (1982). The disadvantage of the Haynes shower head is that its cover plate and shower head support means are not mounted flush to the shower stall wall. Many shower stalls are narrow and provide little room for a person to turn around under the shower head for thorough rinsing. Having an elongated shower head cover and mount protruding several inches into such shower stalls would further limit the room therein for movement while showering.

Another invention resembling the present invention in appearance is the adjustable shower head disclosed in U.S. Pat. No. 3,806,963 to Flynn (1974). For retrofitting onto existing construction it is contemplated for the Flynn invention to be connected to the existing plumbing connection and be mounted so that it bears against the shower wall. The Flynn invention therefore suffers from the same disadvantage of being inappropriate to retrofit in narrow shower stalls. The Flynn invention has spring biased tapes which coil and are attached to the top and bottom of the traveler means to assist the traveler means in moving the Flynn shower head vertically within the slot in its plate member. The spring biased tapes also block water from passing through the slot in which the Flynn shower head moves. The water-blocking spring biased tapes have the disadvantage of not being readily removable for cleaning or replacement, as are the shower head sealing water-resistant flaps of the present invention. A third vertically adjustable shower head is disclosed in U.S. Pat. No. 3,737,107 to Wright (1973). The Wright invention has segments pivotally connected together which form a loop and operate as a flexible band. The Wright shower head is supported by these segments, which also help to keep water from moving behind the shower stall wall. The water supply hose connected to the Wright shower head is tightly coiled within its housing to prevent kinking. The pivotally connected segments are more complex to construct and install than the water resistant flaps which connect to the guiding track rails of the present invention. Also the pivotally connected segments would not be readily removable for replacement or cleaning, as are the water resistant flaps of the present invention with the simple removal of a few bolts. It is not known to have a vertically adjustable shower head attached to a movable bracket on which rollers are laterally attached that move within guiding track rails behind a shower stall wall, which also has a cover plate flush against the shower stall wall, a pair of water resistant flaps which supports the shower head and provides a water seal around it, and a gutter system behind the shower stall wall to redirect into the enclosed shower stall area any water which moves between the water resistant flaps.

SUMMARY OF INVENTION—OBJECTS AND ADVANTAGES

It is the primary object of this invention to provide a shower head support assembly which may be vertically adjustable for use by people of different heights. It is also an object of this invention to provide a vertically adjustable shower head support assembly which is easy to adjust but remains firmly fixed during use. A further object of this invention is to provide a vertically adjustable shower head support assembly which has a cover plate flush against the shower wall when installed with most of its components located behind the wall so as not to intrude on the limited space within some shower stalls. It is also an object of this invention to provide a vertically adjustable shower head support assembly which has sealing means to prevent water from moving behind the shower wall. A further object of this invention is to provide a vertically adjustable shower head support assembly which may be installed in new construction and also easily retrofitted to existing construction. It is also an object of this invention to provide a vertically adjustable shower head support assembly which has sealing means which are easily removable for replacement or cleaning.

As described herein, properly manufactured and installed against a shower stall wall, the present invention would provide means for easily adjusting the vertical height of the shower head to suit the needs of both tall people, short people, and those in between. The shower head would protrude through water resistant flaps into the enclosed shower stall area. A cover plate with an elongated slot therethrough would be positioned over the water resistant flaps to help hold them in place flush against the shower stall wall. Behind the wall, the shower head would be connected to a movable bracket which has rollers attached laterally to it for vertical movement within guiding track rails. Bolts attach one edge of water resistant flaps to the guiding track rails and another set of bolts attach the guiding track rails to the hidden, rear portion of the shower stall wall. Flexible water supply tubing is connected to the movable bracket to provide water to the shower head as it moves in the guiding track rails. An upwardly inclining gutter, a gutter catch, and drain holes prevent water from becoming trapped behind the shower wall by collecting the water and redirecting its movement back into the enclosed shower stall area. The present invention may be easily installed with new construction or retrofitted to existing construction. Also, the shower head may be fixed into pre-selected vertical positions by indentations in the guiding track rails, or if water resistant flaps are made from a sufficiently thick material, the water resistant flaps pressing against each other and also pressing against the shower head will keep the shower head in any selected vertical position as it moves vertically between the water resistant flaps.

The description herein provides preferred embodiments of the present invention but should not be construed as limiting the scope of the vertically adjustable shower head invention. Variations in the size of the shower head, the number of indentations present, the width of the elongated slot in the cover plate, the thickness of the material from which the water resistant flaps are made, the type and number of bolts connecting the water resistant flaps to the guiding track rails and the guiding track rails to the rear portion of the shower stall wall, and the material from which the water resistant flaps are made, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 5 is a front view of the invention.

FIG. 6 is a front view of the movable shower head support of the invention.

DETAILED DESCRIPTION OF PREFERRED EMBODIMENTS

Figure 1:
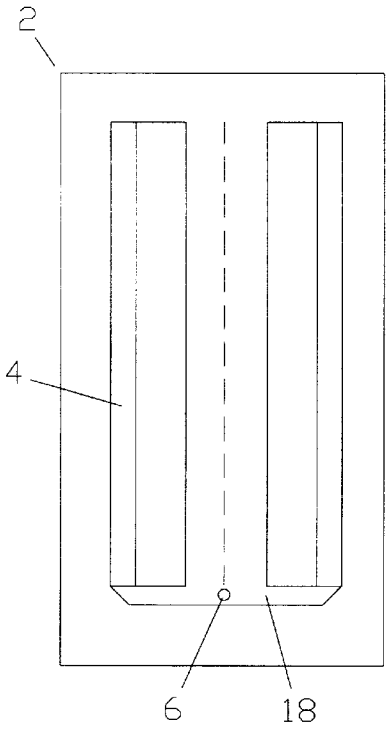
FIG. 1 is a top view of the invention attached to a shower stall.

FIG. 1 shows a preferred embodiment of a vertically adjustable shower head invention 2 attached to a wall 36 of an enclosed shower stall 28 having a drain opening 38. Facing enclosed shower stall 28 is a cover plate 24 having an elongated central slot therethrough, a pair of water resistant flaps 16 positioned behind cover plate 24 one adjacent to the other, and a shower head 22 emerging through the separation between water resistant flaps 16 into enclosed shower stall 28. The size and configuration of shower head 22 is not critical to vertically adjustable shower head invention 2. Shower head 22 moves freely between water resistant flaps 16 and within the slot in cover plate 24. It is contemplated for cover plate 24 to have a flat configuration so that water resistant flaps 16 are flush with wall 36 when installed in enclosed shower stall 28. In the preferred embodiment, it is contemplated for the length of cover plate 24 to range between three and four feet. In the preferred embodiment it is also contemplated for the elongated slot in cover plate 24 to range between one inch and one and one-half inches in width, and be approximately three feet in length. Also, the thickness of water resistant flaps 16 and the material from which water resistant flaps are made are not critical to vertically adjustable shower head invention 2 as long as water resistant flaps firmly seal around shower head 22.

Behind wall 38 one side of each water resistant flap 16 is attached to a separate guiding track rail 8 by bolts 34. In the preferred embodiment it is contemplated for each guiding track rail 8 to be approximately one-half inches wide and approximately four feet long, and to have a square configuration with one side partially open to accommodate the movement of shower head 22. FIG. 1 also shows one edge of each guiding track rail 8 connected to the hidden, rear portion of wall 36 by track rail bolts 32. The use of bolts 34 to attach water resistant flaps 16 to guiding track rails 8, and the use of track rail bolts 32 to attach one edge of each guiding track rail 8 to wall 36, are not critical to vertically adjustable shower head invention 2, and it is contemplated to have any means of attachment, and any size and number of attachment components, such as bolts 34 and track rail bolts 32, which will securely attach water resistant flaps 16 to guiding track rails 8 and guiding track rails 8 to wall 36, but also allow water resistant flaps 16 to be easily removed for replacement or cleaning.

In addition, FIG. 1 shows shower head 22 attached to a movable bracket 12 and a flexible water supply tubing 30 attached to the side of movable bracket 12 remote from shower head 22. Although not shown, movable bracket 12 has a bore therethrough to allow water from water supply tubing 30 to reach shower head 22. Two rollers 10, attached to movable bracket 12 at right angles to shower head 22 and flexible water supply tubing 30, connect movable bracket 12 to guiding track rails 8. In the preferred embodiment it is contemplated for rollers to have a square configuration and be approximately three-eighths inch in width to prevent side-to-side movement within guiding track rails 8. Also, although not shown, it is contemplated for vertically adjustable shower head invention 2 to have stops at the top and bottom of guiding track rails 8 to prevent movable bracket 12 from moving beyond the ends of guiding track rails 8. In the preferred embodiment it is contemplated for movable bracket 12 to be approximately two inches square and to be made of plastic. In the preferred embodiment it is also contemplated for each side of movable bracket 12 to have three-eighths inch square extensions which are approximately one-fourth inches long, to which rollers 10 are attached.

Figure 2:
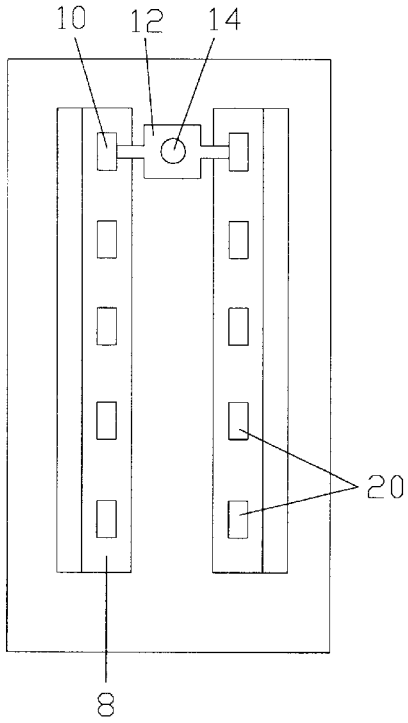
FIG. 2 is a partially cut away front view of the invention.

FIG. 2 shows a gutter unit 4 with a gutter catch 18 and a hole 6 located through the lower central portion of gutter catch 18. In the preferred embodiment it is contemplated for gutter unit 4 to be upwardly inclining and attached behind wall 36 to catch water (not shown) which moves between water resistant flaps 16 toward guiding track rails 8. Gravity would move the water downward toward gutter catch 18 where the water would pass through hole 6 and be redirected into enclosed shower stall 28 for exit therefrom through drain 38.

Figure 3:
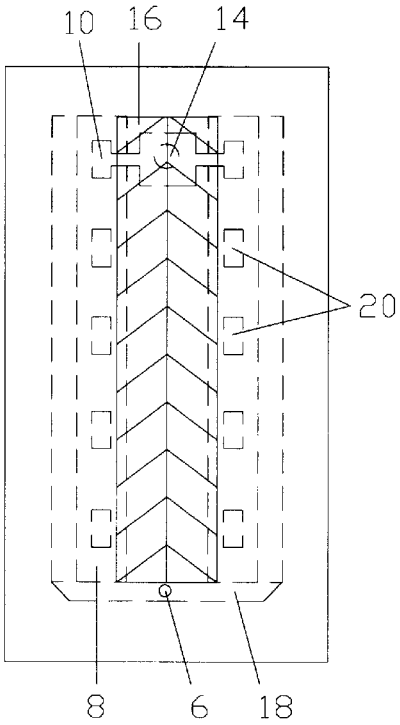
FIG. 3 is a partially cut away front view of the invention.

FIG. 3 shows movable bracket 12 having a male shaft 14 for attachment to shower head 22 and rollers 10 each laterally positioned on movable bracket 12 perpendicular to male shaft 14. FIG. 3 also shows rollers 10 positioned against indentation 20 in guiding track rails 8. The number of indentations 20 may be varied according to use. Although it is contemplated for guiding track rails 8 to have indentations 20 for fixing shower head 22 at preselected vertical positions, the use of indentations 20 is not critical to vertically adjustable shower head invention 2. It is also contemplated that if water resistant flaps 16 were made of a sufficiently thick flexible material, that each water resistant flap pressing against the other and also pressing against shower head 22 would maintain shower head 22 at any preselected vertical position without the use of indentations 20.

Figure 4:
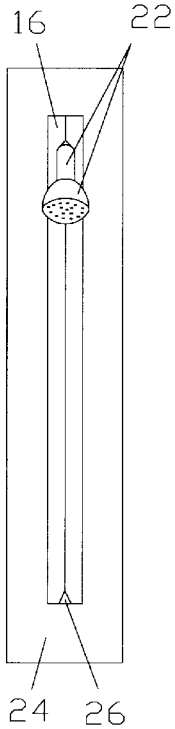
FIG. 4 is a partially cut away front view of the invention.

FIG. 4 shows guiding track rails 8 having indentations 20 and gutter catch 18 with its centrally positioned hole 6 located at the lower edge of guiding track rails 8. FIG. 4 also shows movable bracket 12 with male shaft 14 positioned against the upper most pair of indentations 20. In addition, FIG. 4 shows water resistant flaps 16 overlaying guiding track rails 8 and movable bracket 12.

FIG. 5 shows the portion of vertically adjustable shower head invention 2 which would be visible to a person (not shown) standing within enclosed shower stall 28. FIG. 5 shows cover plate 24 having an elongated rectangular shape and a centrally located, elongated slot through which water resistant flaps 16, positioned behind cover plate 24, are visible. FIG. 5 also shows an opening 26 between the lower portions of water resistant flaps 16 which allows water (not shown) collected behind wall 36 to be redirected into enclosed shower stall 28 for exit therefrom through drain 38.

Figure 7:
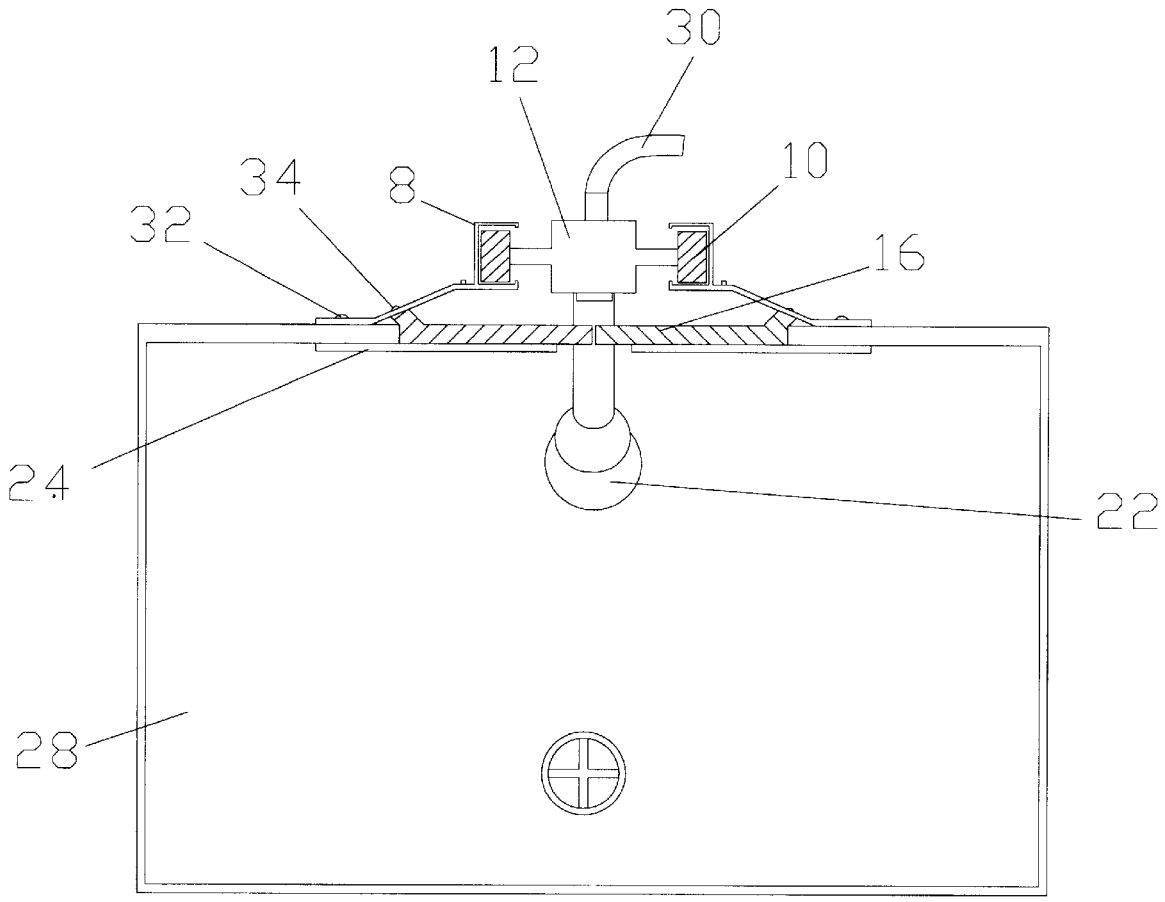
FIG. 7 is a top view of the movable shower head support of the invention.

FIGS. 6 and 7 show rollers 10 each laterally connected to opposite sides of movable bracket 12, and male shaft 14 connected in the same plane, but at right angles to, rollers 10. In addition, FIG. 7 shows flexible water supply tubing 30 connected to the side of movable bracket 12 remote from male shaft 14. When shower head 22 is moved vertically within water resistant flaps 16 and the slot in cover plate 24, vertically adjustable shower head invention 2 may be comfortably used by people ranging in height from four and one-half feet to seven feet tall.

What is claimed is:

1. A vertically adjustable shower head assembly for connection to both the front and rear sides of a wall in a shower stall for the introduction of water into said shower stall at a variety of heights for the bathing comfort of both very tall and very short people, said assembly comprising a shower head; a movable bracket having a bore therethrough and a pair of lateral extensions attached thereto at right angles from said bore, said bore having opposite ends, said shower head connected to one of said opposite ends of said bore; a pair of rollers, one of said rollers attached to each of said lateral extensions; a pair of opposed guiding track rails attached to said rear side of said wall, one of said rollers movably mounted within each of said guiding track rails; a flexible water supply conduit connected to the other of said opposite ends of said bore; an elongated cover plate for attachment to said front side of said wall, said cover plate having an elongated slot therethrough; sealing means positioned between said cover plate and said guiding track plates to keep said water from moving behind said wall, said sealing means attached to said guiding track plates so as to be flush with said wall; and attachment means to connect said sealing means to said guiding track rails so that said sealing means supports said shower head and provides a seal around it to prevent said water from moving behind said wall during vertical movement and use of said shower head.

2. The assembly of claim 1 further comprising a plurality of indentations in each of said guiding track rails for engagement with said rollers for positioning of said shower head at preselected vertical positions.

3. The assembly of claim 1 wherein said sealing means comprises a pair of water resistant flaps.

4. The assembly of claim 3 wherein said sealing means further comprises an upwardly inclining gutter having a lower end, a gutter catch positioned to communicate with said lower end, and at least one hole positioned through said gutter catch so that said gutter and said gutter catch collect any of said water which moved past said water resistant flaps, and said holes redirect said water back into said shower stall.

5. The assembly of claim 1 wherein said bracket extensions, said guiding track rails, and said rollers all have square configurations to prevent side-to-side movement of said shower head during said vertical adjustment.

6. The assembly of claim 1 wherein said attachment means comprise a plurality of bolts so that said sealing means are easily replaceable.

7. A vertically adjustable shower head assembly for connection to both the front and rear sides of a wall in a shower stall for the introduction of water into said shower stall at a variety of heights for the bathing comfort of both very tall and very short people, said assembly comprising a shower head; a movable bracket having a bore therethrough and a pair of lateral extensions attached thereto at right angles from said bore, said bore having opposite ends, said shower head connected to one of said opposite ends of said bore; a pair of rollers, one of said rollers attached to each of said lateral extensions; a pair of opposed guiding track rails attached to said rear side of said wall, one of said rollers movably mounted within each of said guiding track rails; a flexible water supply conduit connected to the other of said opposite ends of said bore; an elongated cover plate for attachment to said front side of said wall, said cover plate having an elongated slot therethrough; a pair of water resistant flaps positioned between said cover plate and said guiding track plates to keep said water from moving behind said wall, said water resistant flaps attached to said guiding track plates so as to be flush with said wall; and attachment means to connect said water resistant flaps to said guiding track rails so that said water resistant flaps support said shower head and provide a seal around it to prevent said water from moving behind said wall during vertical movement and use of said shower head.

8. The assembly of claim 7 further comprising a plurality of indentations in each of said guiding track rails for engagement with said rollers for positioning of said shower head at preselected vertical positions.

9. The assembly of claim 7 further comprising an upwardly inclining gutter having a lower end, a gutter catch positioned to communicate with said lower end, and at least one hole positioned through said gutter catch so that said gutter and said gutter catch collect any of said water which moved past said water resistant flaps, and said holes redirect said water back into said shower stall.

10. The assembly of claim 7 wherein said bracket extensions, said guiding track rails, and said rollers all have square configurations to prevent side-to-side movement of said shower head during said vertical adjustment.

11. The assembly of claim 7 wherein said attachment means comprise a plurality of bolts so that said water resistant flaps are easily replaceable.

12. A vertically adjustable shower head assembly for connection to both the front and rear sides of a wall in a shower stall for the introduction of water into said shower stall at a variety of heights for the bathing comfort of both very tall and very short people, said assembly comprising a shower head; a movable bracket having a bore therethrough and a pair of lateral extensions attached thereto at right angles from said bore, said bore having opposite ends, said shower head connected to one of said opposite ends of said bore; a pair of rollers, one of said rollers attached to each of said lateral extensions; a pair of opposed guiding track rails attached to said rear side of said wall, one of said rollers movably mounted within each of said guiding track rails; a flexible water supply conduit connected to the other of said opposite ends of said bore; an elongated cover plate for attachment to said front side of said wall, said cover plate having an elongated slot therethrough; a pair of water resistant flaps positioned between said cover plate and said guiding track plates to keep said water from moving behind said wall, said water resistant flaps attached to said guiding track plates so as to be flush with said wall; and attachment means to connect said water resistant flaps to said guiding track rails so that said water resistant flaps support said shower head and provide a seal around it to prevent said water from moving behind said wall during vertical movement and use of said shower head; said assembly also comprising an upwardly inclining gutter having a lower end, a gutter catch positioned to communicate with said lower end, and at least one hole positioned through said gutter catch so that said gutter and said gutter catch collect any of said water which moved past said water resistant flaps, and said holes redirect said water back into said shower stall.

13. The assembly of claim 12 further comprising a plurality of indentations in each of said guiding track rails for engagement with said rollers for positioning of said shower head at preselected vertical positions.

14. The assembly of claim 12 wherein said bracket extensions, said guiding track rails, and said rollers all have square configurations to prevent side-to-side movement of said shower head during said vertical adjustment.

15. The assembly of claim 12 wherein said attachment means comprise a plurality of bolts so that said water resistant flaps are easily replaceable.

* * * * *